US007874765B2

(12) United States Patent
Crow

(10) Patent No.: US 7,874,765 B2
(45) Date of Patent: Jan. 25, 2011

(54) BALLAST WEIGHT HAVING REDUCED REMOVAL RESISTANCE AND INCREASED GRIPPING FEATURES FOR IMPROVING EMERGENCY WEIGHT-DROPPING

(76) Inventor: Barry J. Crow, 20371 Lake Forest Blvd., #A-10, Lake Forest, CA (US) 92630

( * ) Notice: Subject to any disclaimer, the term of this patent is extended or adjusted under 35 U.S.C. 154(b) by 0 days.

(21) Appl. No.: 12/215,334

(22) Filed: Jun. 26, 2008

(65) Prior Publication Data

US 2009/0324340 A1 Dec. 31, 2009

(51) Int. Cl.
*B63C 11/30* (2006.01)

(52) U.S. Cl. ..... 405/186

(58) Field of Classification Search ..... 405/186
See application file for complete search history.

(56) References Cited

U.S. PATENT DOCUMENTS 3,039,273 A * 6/1962 Swindell ..... 405/186
3,851,488 A 12/1974 Schuler
4,440,525 A 4/1984 Perla
4,789,270 A 12/1988 Selisky
4,848,965 A 7/1989 Peterson
4,887,932 A * 12/1989 Toth ..... 405/186
5,076,575 A 12/1991 Eylander
5,137,502 A 8/1992 Anastasi
5,913,640 A 6/1999 Bortner
5,944,450 A 8/1999 Anderson
6,499,913 B2 12/2002 Garofalo
6,749,370 B1 6/2004 Urabe et al.
D542,368 S 5/2007 Lindell
2002/0067955 A1 6/2002 Carmichael

* cited by examiner

*Primary Examiner*—Frederick L Lagman
(74) *Attorney, Agent, or Firm*—Rylander & Associates PC; Kurt Rylander; Jon Reali

(57) ABSTRACT

A diving weight apparatus has a solid, body with a curved outer conformation. An elongated aperture extends through the body between a front and a back surfaces. The elongated aperture is large enough to accept two fingers of a person's hand therein when the two fingers are arranged in side-by-side positions. A pouch accepts the body and is likewise curved. A diving vest accepts the pouch an is likewise curved.

13 Claims, 4 Drawing Sheets

BALLAST WEIGHT HAVING REDUCED REMOVAL RESISTANCE AND INCREASED GRIPPING FEATURES FOR IMPROVING EMERGENCY WEIGHT-DROPPING

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCOPORATION-BY-REFERENCE OF A MATERIAL SUBMITTED ON A COMPACT DISC

Not applicable.

REFERENCE TO A "MICROFICHE APPENDIX"

Not applicable.

SEQUENCE LISTING

Not applicable.

BACKGROUND OF THE INVENTION

1. Field of the Present Disclosure

This disclosure relates generally to buoyancy weights used for attaining neutral buoyancy during sub-surface swimming activities and more particularly to such a weight and a weight system that provides improved features for weight dropping.

2. Description of Related Art Including Information Disclosed Under 37 CFR 1.97 and 1.98

Lindell, U.S. Pat. No. D542368, discloses a design for a diving weight.

Carmichael, U.S. 2002/0067955, discloses an active control releasable ballast system for dive equipment which in one embodiment includes a removable pocket that is secured with a side release buckle within a fixed pocket. The buckle is required to be opened before the weight contained in the pocket can be dropped or given to another individual in or out of the water. Thus, the release of the weights is a conscious and deliberate act.

Schuler, U.S. Pat. No. 3,851,488, discloses a divers weight that is secured to the belt in a manner that enables quick and easy weight changes. The weights are retained by a case having protruding ribs which grab the belt so as to prevent the weights from sliding or shifting on the belt.

Perla, U.S. Pat. No. 4,440,525, discloses a divers weight belt that is formed from a single piece of laminated material having closed cell foam neoprene covered on each side with stretchable fabric. A plurality of rectangular pockets are formed along the belt to hold standard rectangular lead diving weights. An upward extending flap of the material is provided with Velcro® closure material and the outer surfaces of the pockets provided with mating Velcro® closure material to permit closing of the pockets. Two ends of the belt project from the pockets and are provided with Velcro® closure material. The diver places a belt with desired weights inserted in the pockets around his waist with the pocket flap contacting his weight and closes the belt by engaging the Velcro® ends. In an emergency, the belt can be quickly dropped by ripping the ends apart.

Selisky, U.S. Pat. No. 4,789,270, discloses a diving weight for scuba and other divers that is particularly designed to hold the weight in conformance to the diver's body and including a surface finish to prevent or substantially eliminate marring and scratching of the same. Belt receiving slots are provided along the length of the weight with a spacing formulation to hold the weight and maintain the attachment belt in close conformance to the user's body. The slots and weight are designed to allow the belt to pass from a recessed interior surface thereof about a recessed portion of the exterior surface and back to the interior thereof to hold the weight close to the user's body. The interior and exterior recesses of the weight allow for close conformity of the belt to the weight and the weight to the user's body. The weight is shaped with a radius on all mating surfaces to facilitate dipping and coating of the weight with a vinyl material. The vinyl material provides and is selected to provide a matte finish to the entire exterior surfaces of the weight, including the slot surfaces. The matte finish substantially eliminates the appearance disfiguration as compared to smoothly coated weights.

Peterson, U.S. Pat. No. 4,848,965, discloses an improved scuba weight that has a hex-nut locking device molded into the weight. The hex-nut locking device secures the weight to a diver's belt, but can be easily loosened, permitting the casting off of the weight, including in underwater operations, if desired.

Eylander, U.S. Pat. No. 5,076,575, discloses a weight belt made from a sheet of flexible material that has two strips of material over one face and is joined by stitched seams to form a number of pockets side-by-side, the pockets containing plates of lead, and being closed by further folding of the sheet to bring the pockets face to face, where they are retained by touch-and-hold material. They can be lifted away for adding or reducing the number of lead plates. Access to some of the plates can be provided to allow removal or replacement without necessarily removing the belt.

Anastasi, U.S. Pat. No. 5,137,502, discloses a disc-shaped weight that includes a circular opening in the center and a pair of diametrically opposed, elongated oval openings disposed parallel to one another and equidistant from the circular opening. The oval openings are positioned in the disc-shaped weight so that the fingers and thumb of a human hand may be disposed through the openings for sufficient gripping of the weight. The distance between the outer periphery of the elongated side of either opening, proximal to the outer periphery of the disc member, is dimensioned so that the fingers of a human hand can be disposed through the desired opening and the thumb can be wrapped around the outer periphery of the weight, for sufficient gripping of the weight. The periphery of the elongated oval openings and outer periphery of the weight is rounded to aid in gripping of the weight.

Bortner, U.S. Pat. No. 5,913,640, discloses a weight drop pocket for a scuba diver that contains a flap closed pocket for containing a weight, with a stiffener secured to the pocket. The pocked has an opening through which a projection from a mating element secured to a skin diver apparatus may be inserted with the pocket and the mating element retained in a pre-selected orientation and held in place by a spring biased rod inserted through the projection thereby locking it to the mating element until the rod is withdrawn by a force which overcomes the spring bias.

Anderson, U.S. Pat. No. 5,944,450, discloses a buoyancy compensator for a scuba diver vest that has a pocket on each side of the front of the vest, and a weight module removably positioned in each pocket. Each weight module includes an envelope releasably mounted in the pocket, a weight packet carried within the envelope, a weight removably mounted in the envelope, a strap operatively connected to the envelope and releasably connected to the vest. The weight is dropped from the weight packet by pulling the weight packet from the pocket and the envelope is returned to the pocket by a pair of elastic bands.

Garofalo, U.S. Pat. No. 6,499,913, discloses a hydrostatic balancing jacket that includes a coupling between at least one of the jacket walls and one ballast. The coupling includes complementary coupling elements reciprocally movable on the jacket wall and on the ballast, and a locking structure for the coupling.

Urabe et al., U.S. Pat. No. 6,749,370, disclose a buoyancy compensating jacket with a waist portion having a pocket with a first flap, a pouch having a flat cord adapted to be inserted into and taken out from the pocket with a weight packed into the pouch. As a guide means for the flat cord, at least one of a substantially C-shaped guide ring provided at a distal end of the first flap substantially in the vertically middle and a groove formed on an outer surface of the pocket and/or an inner surface of the first flap substantially in the vertically middle.

The related art described above discloses various diving weights, diving belts, ballast systems and buoyancy compensating jackets. However, the prior art fails to disclose a diving weight with an aperture specifically having an aperture with a width for receiving two fingers of a grown persons hand, a diving pocket and vest therefor. The prior art also fails to teach a curved weight that conforms to the diver's torso for improved convenience and safety as will be defined and shown herein. The present disclosure distinguishes over the prior art providing heretofore unknown advantages as described in the following summary.

BRIEF SUMMARY OF THE INVENTION

It is a known problem that when a diver is in trouble during a dive, as for instance if compressed air is lost, or when entangled in sub-surface formations or vegetation, it is necessary to eliminate any neutral buoyancy element possible, such as diving weights, so as to improve the divers ability to reach the surface as quickly as possible. It is well established in the scuba diving industry to provide for the quick removal and dispensing of any neutral buoyancy weights carried by the diver. Such provisions include the use of diving apparatus that has quick disconnect features. One such feature is the provision of a quick release buckle on a diver's weight belt. Another is the use of weight pouches that hold the diver's weights, wherein quick release snaps and handles or rings are provided so that they may be separated from a diving jacket or vest quickly, and dropped.

Such safety devices have been known to fail with particularly dire consequences. For instance, diving weights are commonly elongated rectangular shapes, as shown in FIG. 5 of U.S. Pat. No. 6,749,370. It is noted that in this prior art patent both the weight 60 and the pouch 51, that carries the weight 60, have planar surfaces, that is, they are linear in conformation. However, as shown in FIG. 1 of U.S. Pat. No. 5,994,445 the diving vest 12 is meant to conform to a human torso which is not planar, but rather round. This presents a problem when the vest is wrapped tightly about the torso because the side walls of the vest pockets which hold the weight pouches tend to press against the linear weight, which is rigid (generally made of lead). This results in a clamping action of the vest on the pouch and its weight. When the diver is rotund, the clamping action can be quite strong.

When a diver is in trouble, panic often sets-in, and the diver may forget to drop the diving weights in his/her struggle to reach the surface. If the diver tries to drop the weights and remembers that the pouch has a pull-ring or a handle, the above mentioned clamping action may retard and restrain the pouch within the vest pocket against attempts at pulling it out. Should this occur, dive training teaches the diver to open the flap on the pouch and manually remove the weight. For this purpose some weights have a finger hole; see FIG. 3 of U.S. Pat. No. 5,076,575, where the finger is to be inserted into the hole to achieve leverage in pulling the weight out of the pouch in order to drop it. The prior art teaches that such a finger hole is round and able to accept a single finger. However, when diving in chilly waters, when diving gloves are used, when the diver is a child, and under other circumstances and conditions, a single finger may not fit into the hole, if it fits a single finger may not have the necessary gripping strength to pull the weight, especially when the previously mentions clamping action is present.

The present invention overcomes the above discussed problems. Firstly, the present invention diving weight is curved to conform more fully to the human torso so that the clamping problem is mainly overcome. Secondly, the present invention diving weight has an elongated hole sized and positioned for receiving at least two human fingers so as to enable considerable leverage in pulling the weight from its pouch. Finally, the present invention provides a particularly high friction gripping surface to maximize the ability for the fingers to grip the diving weight in a water environment.

This disclosure teaches certain benefits in construction and use which give rise to the objectives described below.

A primary objective inherent in the above described apparatus and method of use is to provide advantages not taught by the prior art.

Another objective is to provide a diver's ballast weight that more accurately conforms to the human torso so as to avoid clamping forces that might resist an intended weight drop.

A further objective is to provide such a ballast weight that provides a means for more aggressively gripping the weight with less likelihood of slipping when forcibly removing it from its pouch in an emergency.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present apparatus and its method of use.

Figure 1:
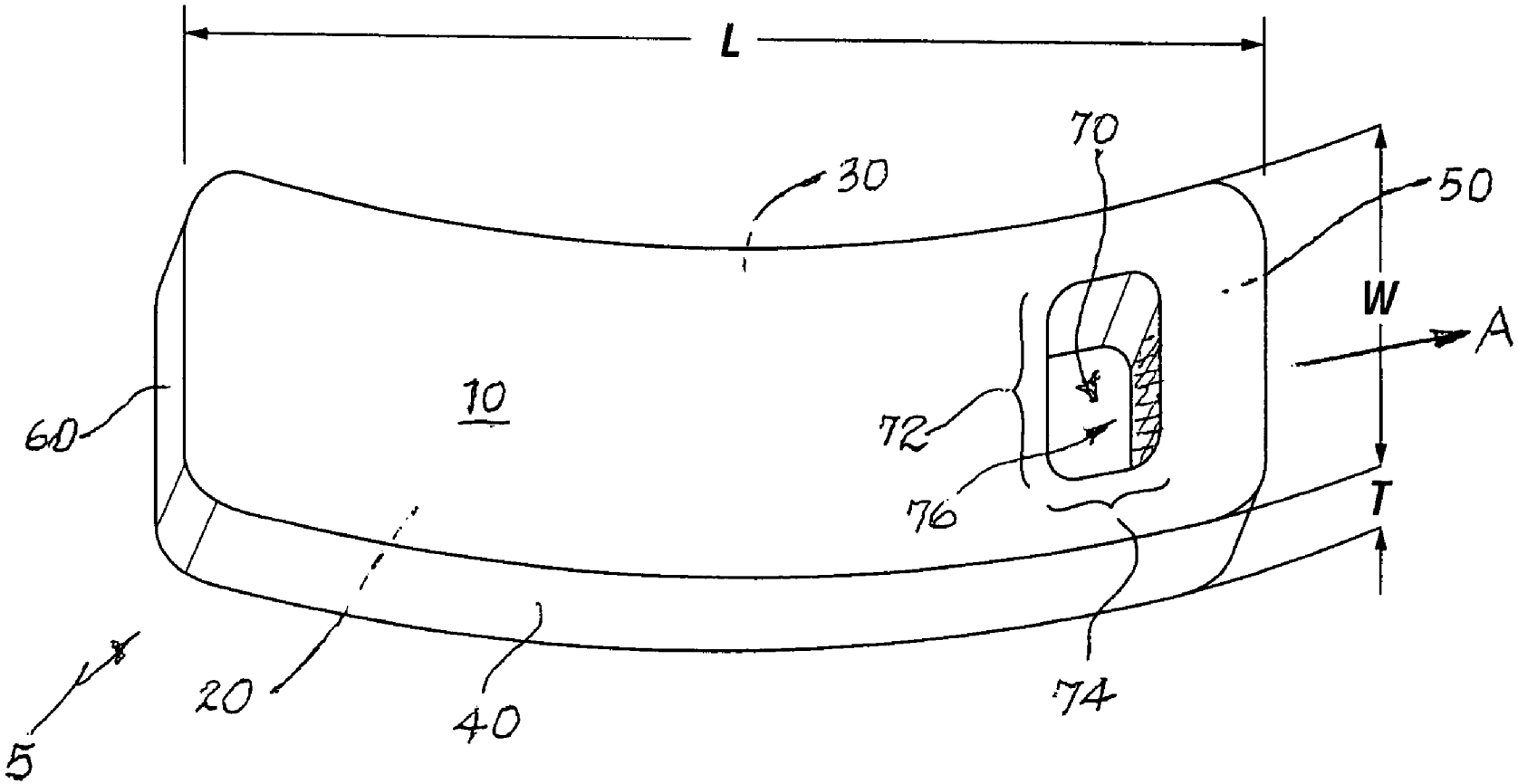
FIG. 1 is a perspective view of a diving weight of the presently described apparatus showing its curved conformation.

Described now in detail is a diving weight and diving weight system of the present invention. As shown in FIG. 1 the diving weight is a solid object. It is made preferably of lead or other heavy material. As shown the weight, referred to herein as a body 5 is a curved rectangular shape with an outer surface comprising a front surface 10 and a back surface 20, mutually opposing, thereby together defining a thickness T of the body 5. Likewise, a left side surface 30 and a right side surface 40, also mutually opposing, establish a width W of the body 5. A top surface 50 and a bottom surface 60, mutually opposing surfaces, establish a length L of the body 5.

The body 5 has an elongated aperture 70 that extends through the body 5 of the diving weight between the front 10 and back 20 surfaces and is aligned with the top surface 50 in a position close to the top surface 50; preferably within an inch or so. The aperture 70 has an aperture length 72 and an aperture width 74 of such size as to accept two side-by-side fingers of an adult person's hand. A person's two fingers, preferably the index finger and the middle finger, when positioned side-by-side can be placed into contact with the back surface 20 engaging therewith from the direction of the top surface 50 to an extent that the tips of these two fingers can be pushed into aperture 70. Once engaged with aperture 70, the two fingers are able to curl around and bend into contact with an aperture surface 76 which is a rough surface, as shown, having a machined texture. When this is accomplished, the two fingers are unlikely to slip off aperture surface 76 due to its roughness while pulling the diving weight in the direction of arrow "A."

As shown in FIG. 1, body 5 has a uniformly curved conformation along its length L, and the extent of the curvature corresponds to the curvature of the human torso, roughly curving between 8 and 12 degrees over a length of approximately 8 inches. Clearly, for athletic men, women and children, torso conformations differ widely, so that the appropriate weight, length and curvature of body 10 will differ accordingly.

The diving weight is made of a material that has a density of at least 11 g $cm^{-3}$. The width W of the diving weight is between 2 and 3 inches, the length L is between 6 and 8 inches, and the thickness T is between ½ and 1½ inches. Therefore, the diving weight may weigh between 2 and 10 pounds. In order to extract a diving weight of 7 pounds with on finger is difficult if not impossible, especially if clamping forces, as described above, are causing significant sliding friction to resist removal of the weight from the pouch.

Figure 2:
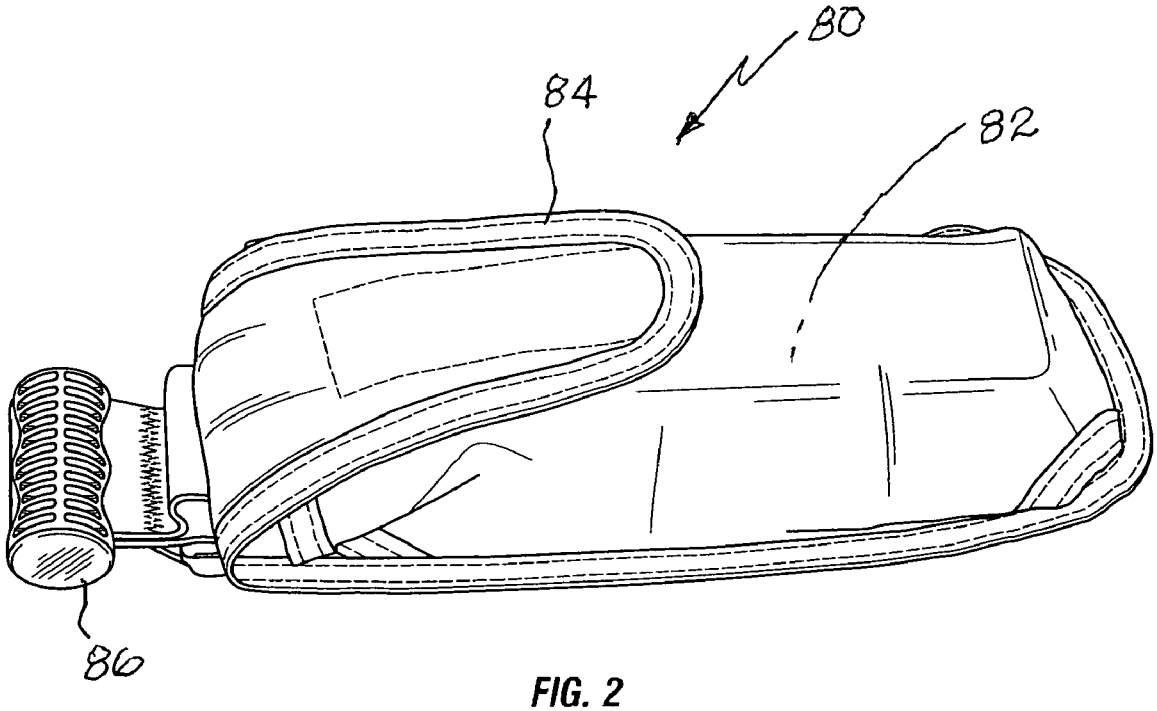
FIG. 2 is a perspective view of a diving pocket of the apparatus shown in a closed attitude.

In FIG. 2 pouch 80 is illustrated. Pouch 80 provides an interior space 82 sized to accept body 5 in a relatively tight-fitting manner so that the body 5 does not tend to shift or rotate during swimming motions and movement through the water. Body 5 is secured within pouch 80 by flap 84. A handle 86 is attached to pouch 80; and is used for pulling pouch 80 from a pocket 92 in a diving vest 90 as shown in FIG. 4.

Figure 3:
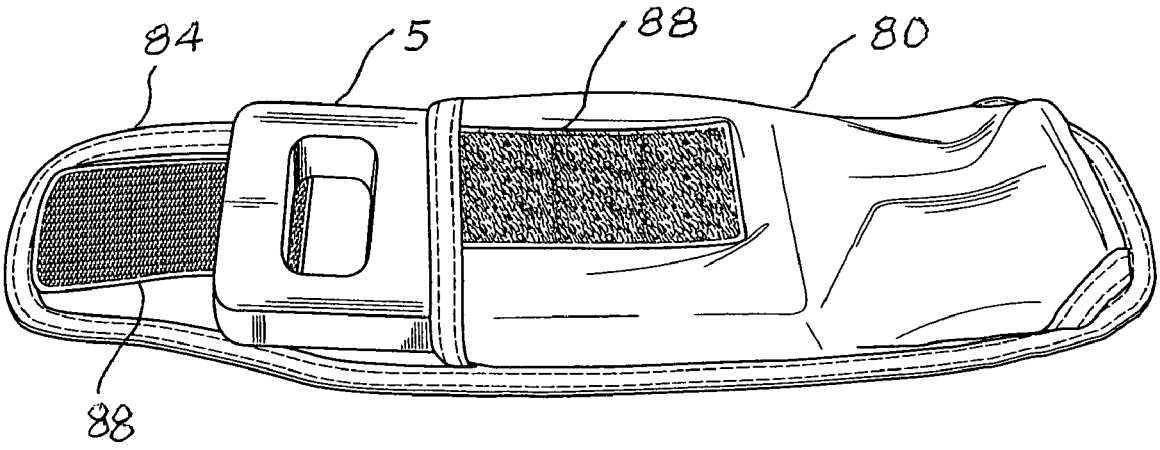
FIG. 3 is a perspective view thereof shown in an open attitude and with the diving weight partly removed.

In FIG. 3, body 5 is illustrated as partially inserted or removed from the pouch 80, and it is shown that flap 84 is normally secured by a surface fastening means 88 such as snaps, clasps, clips, or preferably Velcro®. The fastening means 88 should be easily defeated in an emergency if it is found difficult to withdraw the pouches 80 in order to gain access to the diving weights, that is body 5.

Figure 4:
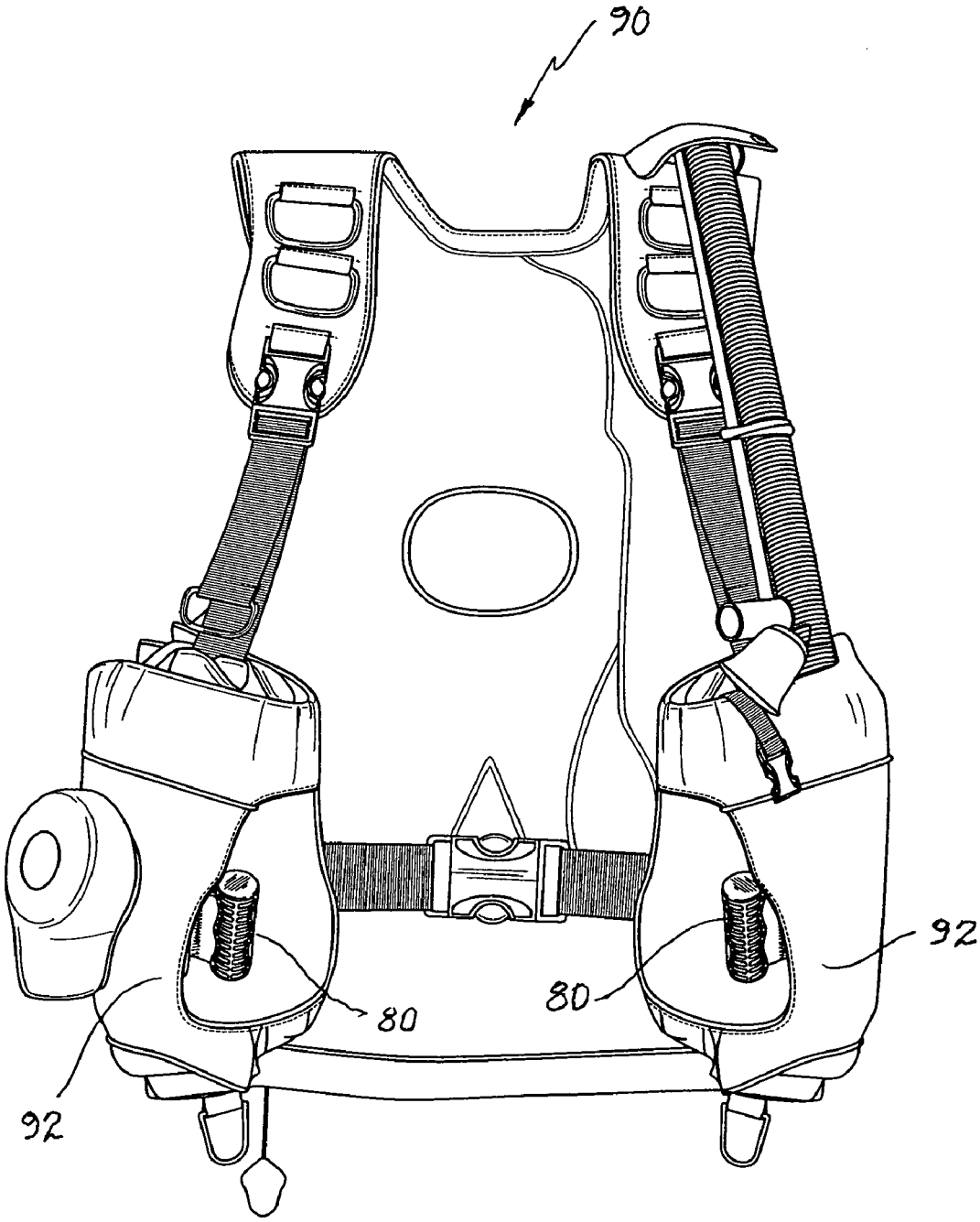
FIG. 4 is a front elevational view of a diving vest showing the locations of a pair of the diving pockets when engaged with the vest during a dive.

FIG. 4 shows the positions of pockets 92 on vest 90, and of pouches 80 within the pockets 92. Here it is clearly shown that the pockets 92 tend to wrap around the sides of the vest 90 and when vest 90 is drawn tightly about the torso, the side walls of the pockets 92 a drawn into physical contact with the pouches 80.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A diving weight apparatus comprising:

a solid body having front and a back surfaces, the front and back surfaces defining a thickness of the body;

a left side and a right side surfaces defining a width of the body, the width of the body approximately between 2 and 3 inches; and a top and a bottom surfaces defining a length of the body;

an elongated aperture extending through the body between the front and back surfaces;

the elongated aperture having an aperture length and an aperture width, the aperture length aligned in parallel with the top surface of the body and proximal thereto, the aperture length less than the approximately between 2 and 3 inch width of the body and the aperture width less than the aperture length;

the elongated aperture to receive one or two fingers of an adult person therein when the two fingers are arranged in side-by-side juxtaposition, and at least one interior surface of the elongated aperture including a highly roughened texture to improve traction between the at least one interior surface of the elongated aperture and the one or two fingers of the adult person inserted into the elongated aperture.

2. The diving weight apparatus of claim 1, wherein the weight is made of a material having a density of at least 11 g·cm−3.

3. The diving weight apparatus of claim 1, wherein the the body length is between 6 and 8 inches and the body thickness is between ¼ and 1½ inches.

4. The diving weight apparatus of claim 1, further comprising in combination therewith, a pouch having an interior space sufficient for receiving the body therein.

5. The diving weight apparatus of claim 4, further comprising in combination therewith, a diving vest having a pocket with an interior space sufficient for receiving the pouch therein.

6. The diving weight apparatus of claim 1, the elongated aperture within approximately 1.0 inch from the top surface of the body.

7. The diving weight apparatus of claim 6, the elongated aperture within approximately 1.0 inch from the top surface of the body to receive the one or two fingers of the adult person therein, the one or two fingers of the adult person to curl around and bend into contact with the at least one interior surface of the elongated aperture including the highly roughened texture.

8. The diving weight apparatus of claim 1, the interior surface of the elongated aperture closest to the top surface of the body including a highly roughened texture to improve traction between the at least one interior surface of the elongated aperture and the one or two fingers of the adult person inserted into the elongated aperture to substantially grip the diving weight apparatus.

9. The diving weight apparatus of claim 7, the substantial grip to enable the adult person to rapidly extract and jettison the diving weight apparatus.

10. The diving weight apparatus of claim 1, substantially the entire interior surface of the elongated aperture including a highly roughened texture to improve traction between the entire interior surface of the elongated aperture and the one or two fingers of the adult person inserted into the elongated aperture to substantially grip the diving weight apparatus.

11. The diving weight apparatus of claim 10, the substantial grip to enable the adult person to rapidly extract and jettison the diving weight apparatus.

12. The diving weight apparatus of claim 1, the length of the body defining a curvature of the diving weight apparatus, the curvature to substantially conform to an adult person torso.

13. The diving weight apparatus of claim 12, the curvature of the diving weight apparatus to curve approximately between 8.0 and 12.0 degrees along the length of the body.

* * * * *